United States Patent [19]

Carlow

[11] Patent Number: 4,561,545

[45] Date of Patent: Dec. 31, 1985

[54] SORTING CONVEYOR

[75] Inventor: Charles A. Carlow, Edinburgh, Scotland

[73] Assignee: National Research Development Corp., London, England

[21] Appl. No.: 488,604

[22] Filed: Apr. 25, 1983

[30] Foreign Application Priority Data

Apr. 23, 1982 [GB] United Kingdom ..... 8211777

[51] Int. Cl.[4] ..... B07C 5/36

[52] U.S. Cl. ..... 209/564; 209/705; 209/942

[58] Field of Search ..... 209/546, 552, 564–566, 209/702, 705, 939, 942

[56] References Cited

U.S. PATENT DOCUMENTS

| | | | |
|---|---|---|---|
| 4,164,291 | 8/1979 | Carlow | 209/942 X |
| 4,184,598 | 1/1980 | Cowlin et al. | 209/705 |
| 4,348,277 | 9/1982 | Cowlin et al. | 209/705 |
| 4,351,437 | 9/1982 | Long | 209/939 X |
| 4,410,091 | 10/1983 | Cowlin et al. | 209/705 X |

FOREIGN PATENT DOCUMENTS 1534590 12/1978 United Kingdom .

*Primary Examiner*—Randolph A. Reese
*Assistant Examiner*—Edward M. Wacyra
*Attorney, Agent, or Firm*—Cushman, Darby & Cushman

[57] ABSTRACT

Sorting apparatus conveying articles through an inspection station includes an operator manipulated indicator which cooperates with an orthogonal sensing matrix beneath the conveyor to provide position and article size information used to selectively actuate deflection fingers to deflect an indicated article.

19 Claims, 8 Drawing Figures

Figure 1A:
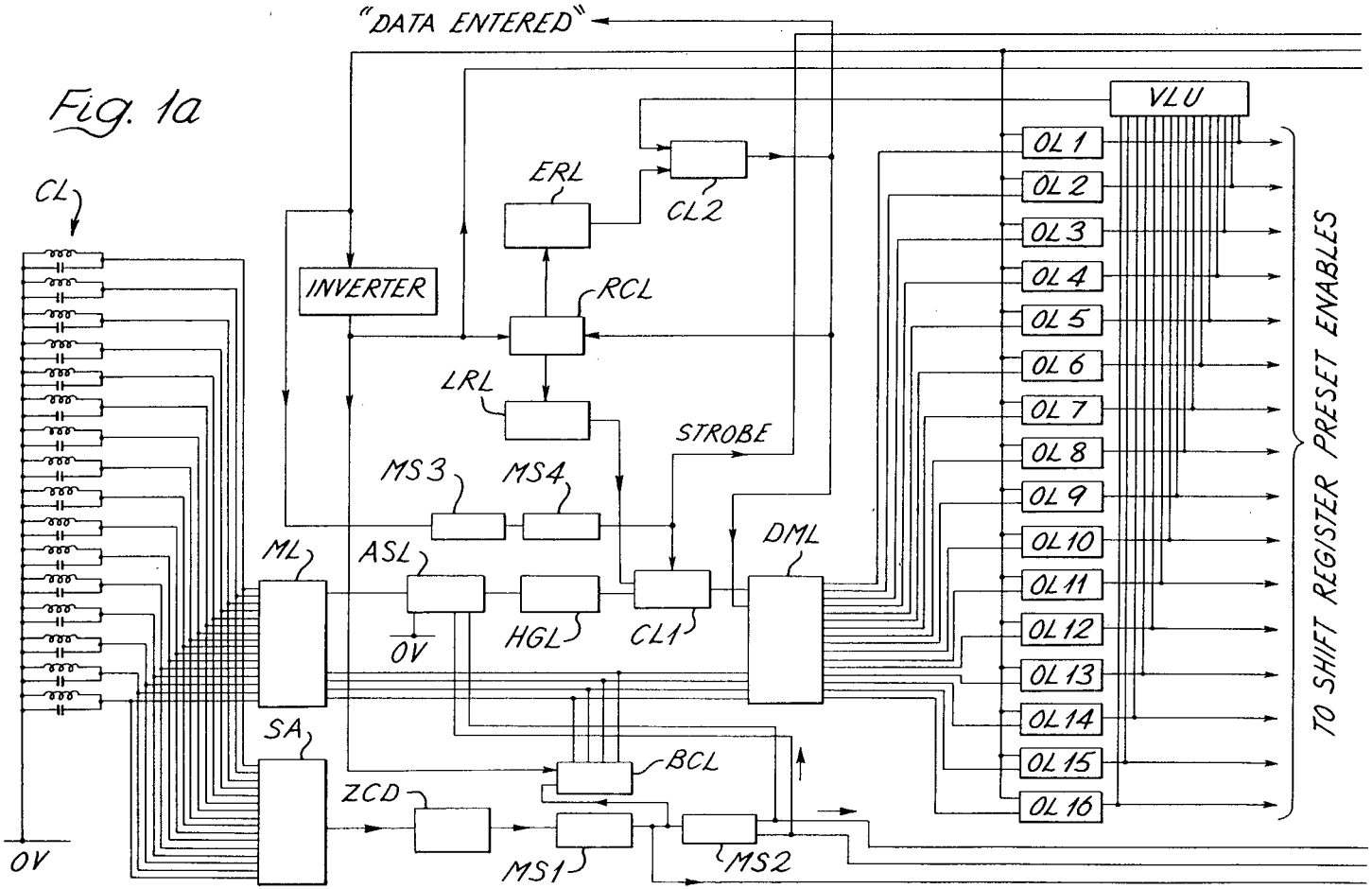

PSU
5Vdc
T1
240V AC
L
N
E
470
1K
470
470
DA3
MS11
MS12
MS13
MS14
MS15
MS16
Q̄
Q̄
WD1
WD2
0V

SORTING CONVEYOR

This invention relates to sorting.

When the sorting of a large number of items is to be carried out it is convenient to place the items on a conveyor or similar device and move the items past one or more sorters who determine how each item compares with a particular requirement such as soundness, colour, size, quality etc. Having decided about an item the sorter then has to cause the item to be dealt with in the manner appropriate to the decision. Thus a faulty item may have to be removed or small items separated from larger ones. It would be possible for a sorter to mark each item with a machine-readable mark so that the items can be separated out by a subsequent machine. However it is not possible or desirable to apply such marks on many items. Accordingly there is a need for a sorting technique which does not need a mark to be applied. U.K. Pat. No. 1,534,590 discloses a technique in which an array of selectable sites is set up and each site can be identified by an appropriate signal. The site corresponding to an object to be sorted can be identified by a selector effective as the object passes a site and the object thereby identified by its correspondence with a specific site can be separated by any suitable arrangement actuated by the side identifying signal.

However the need for an array of sites with one of which an object to be sorted can be associated can restrict the use of the technique as the array may need to be altered for different types of objects, e.g. different sizes, and each site in the array must be able to hold the largest and the smallest sizes of the range of objects.

There is therefore a need for a more flexible technique of sorting.

It is an object of the invention to provide an improved sorting technique which is not constrained by the need for an object related array of individual sites in an array.

According to the invention there is provided sorting apparatus including a support surface to receive objects to be sorted, means to move received objects to a point of selective discharge from the support surface, means to produce said selective discharge, an indicator movable to objects supported on the surface to indicate the position of an object to be sorted in a particular way by said selective discharge, means to co-operate with the indicator to record the position of the indicator, means to generate a signal to identify the position to be recorded, means responsive to the recorded position and the action of the means to move the objects to operate said selective discharge means to appropriately sort the object on discharge from the surface.

The means to produce selective discharge may be operable to adjust the size of an object to be discharged. The means to generate a signal to identify the position to be recorded and the means to record the postion may co-operate to also record an indication of the proximity of the indicator to the position, representing the size of the object whose position is indicated. The means to produce selective discharge may be responsive to the recorded indication of object size to be adjusted to the object size.

The indicator may include the means to generate a signal and the means to co-operate with the indicator may include electronic circuit means to compare in turn the generated signal collected by each of a plurality of pick-up means spaced under the support surface with a time-varying signal to determine on their coincidence the pick-up means nearest to the indicator postion. The time-varying signal may be a ramp changing in value towards the picked-up signal changing in the opposite sense as the indicator position is approached. The change is preferably linear and in synchronism with a scan of all the pick-up means. The comparison may be made separately along orthogonal or otherwise inclined directions below the support surface, e.g. along and across the direction of movement of the objects or in two directions both inclined to a direction of movement.

The indicator may include means to generate a signal and the means to co-operate with the indicator may include electronic circuit means to compare simultaneously the generated signal collected by each of a plurality of pick-up means spaced under the support surface with a time-varying signal to determine on their coincidence the pick-up means nearest to the indicator position and then inhibit further coincidence. The identity of the pick-up means may be encoded as a multibit binary word for use by the selective discharge control means.

The means to co-operate with the indicator may include electronic circuit means to assess the size of the generated signal used to determine the pick-up means nearest to the indicator position. The size of the generated signal may be assessed by comparison of a further time-varying signal, preferably of nonlinear form, with a signal derived from the time-lapse before the coincidence of the first ramp signal and the generated signal. The further signal may be an exponential ramp signal. The time-lapse derived signal may be a stepwise varying voltage.

According to a particular aspect of the invention there is provided a sorting control apparatus for a sorting station of a conveyor having at the station an array of signal pick-up coils and an indicator movable over the array to indicate a position of a conveyed object to be sorted in a particular manner, together with means to selectively remove an indicated object, the control apparatus including a circuit arrangement to supply a signal from each pick-up coil for each sense of the array to a comparator for comparison with a ramp waveform to identify the coil nearest to the indicator position for each said sense and record the identity of the identified coils, means to relate the movement of objects towards the means to remove objects selectively with the indicator position represented by the identified coils of the array and to provide an output to the means to remove objects selectively to cause said means to remove a conveyed object having a position indicated by an indicator and then recorded on movement of said object to the removal means.

The control apparatus may also derive information about the size of an object at an indicated position and supply this information to the selective removal means.

Figure 1B:
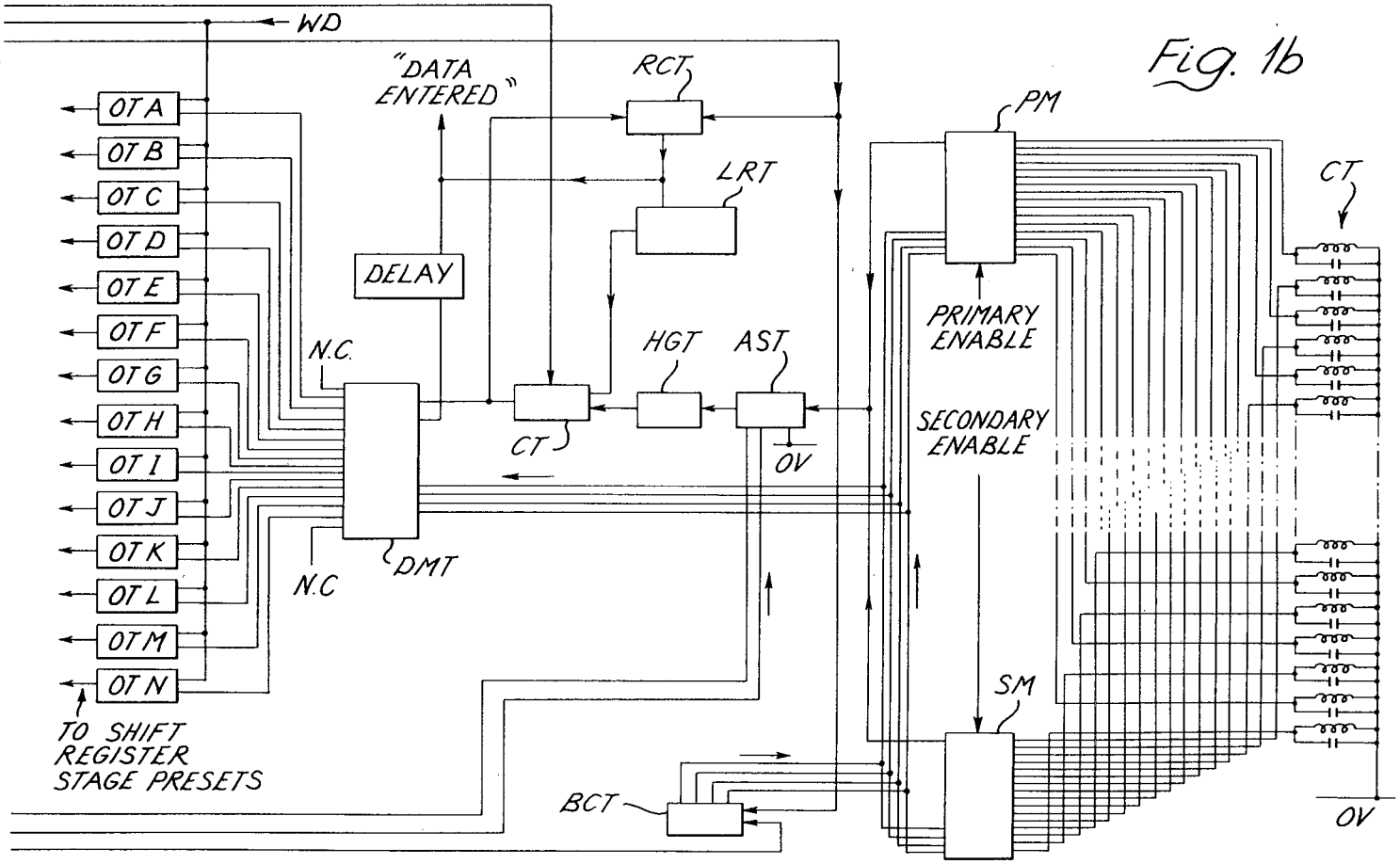
Figure 2:
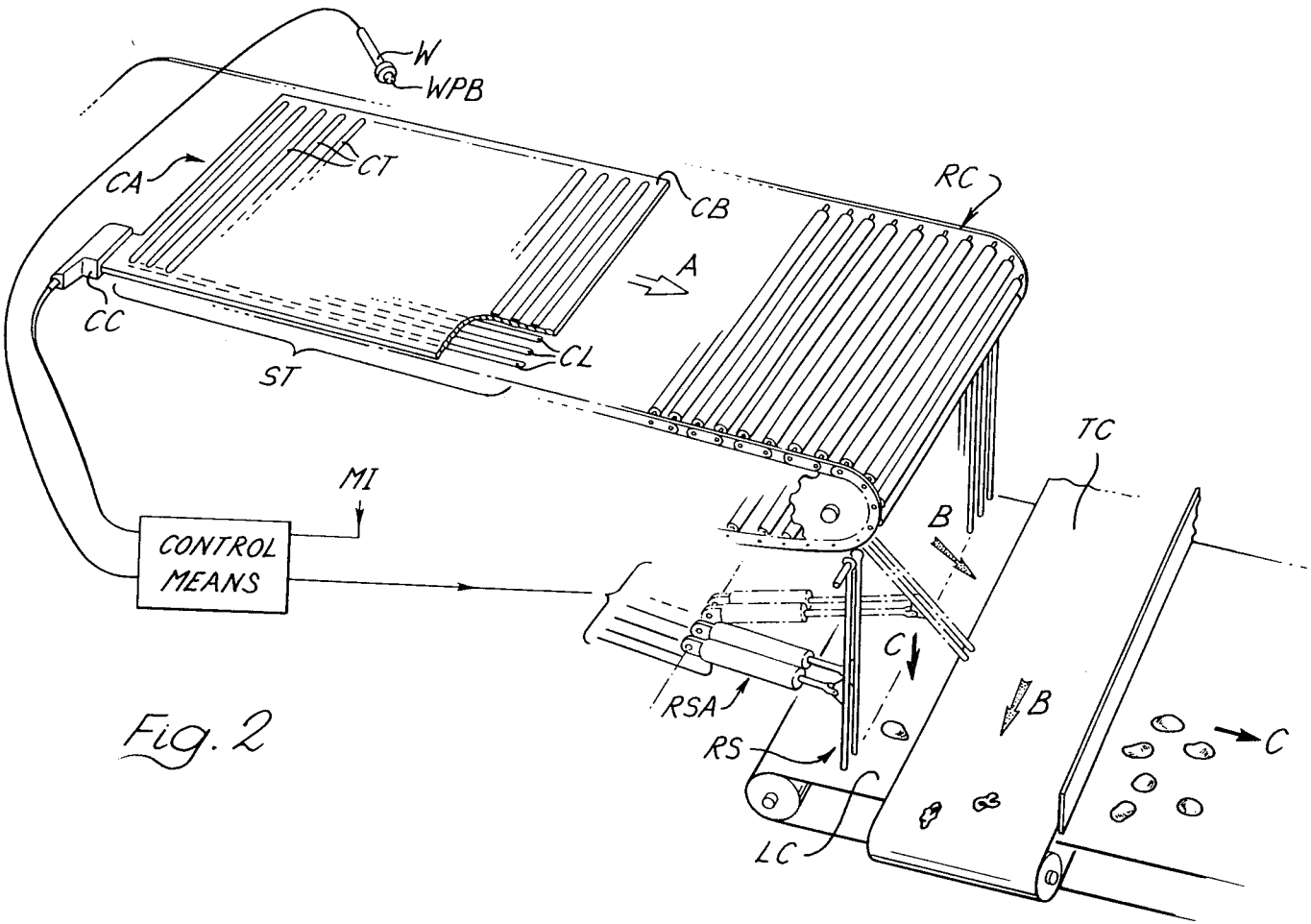
Figure 3:
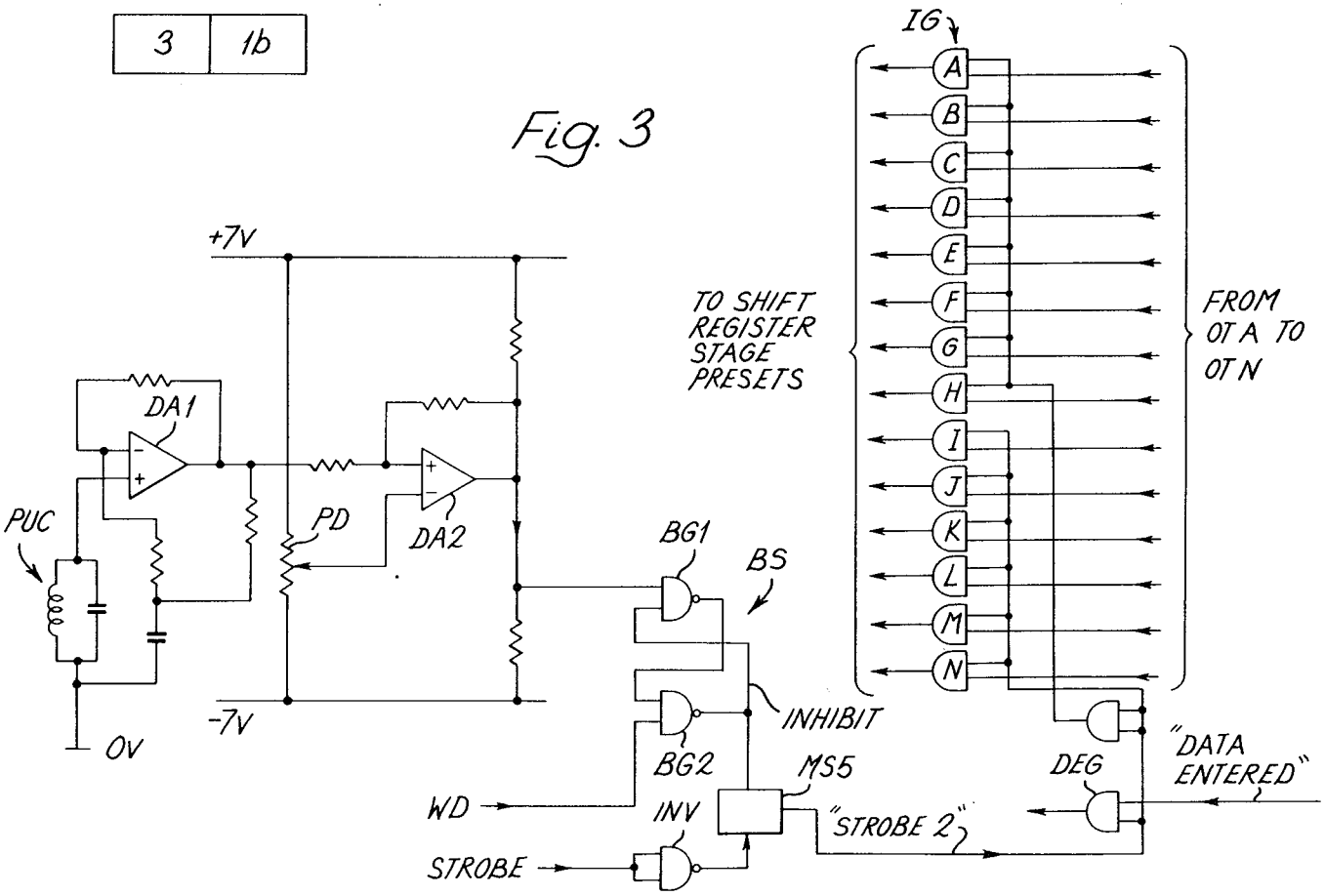
Figure 4:
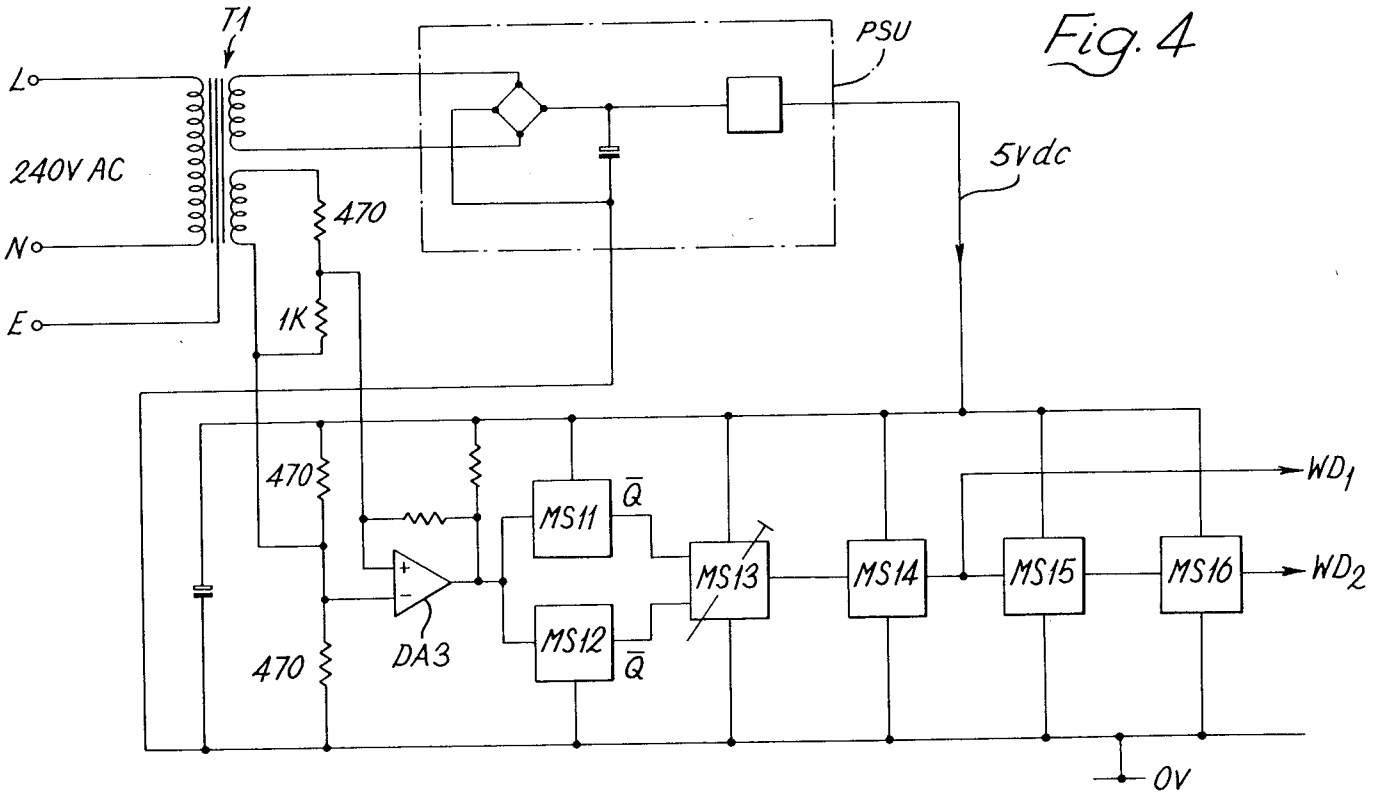

Embodiments of the invention will now be described with reference to the accompanying drawing in which:

FIGS. 1*a* and 1*b* show a block schematic circuit diagram of a sorting control apparatus, FIG. 2 shows in outline a conveyor and sorting station, FIGS. 3 and 4 show an additional circuit for use with the embodiment of FIG. 1, and FIGS. 5*a*, 5*b* and 5*c* show another sorting control apparatus block schematic circuit diagram.

As the invention can be applied to sorting apparatus as described in UKPS No. 1,534,590 and U.S. Pat. No. 4,164,291 with modifications to be mentioned, the disclosure of this specification is incorporated by reference thereto.

The arrangement and operation of the sorting control apparatus will be described first followed by its application to various types of conveyor and sorting station. It will be assumed that there is an array of generally orthogonal pick-up coils arranged beneath a conveyor support surface and a "wand" indicator movable over the array to indicate the position of an object to be sorted, similar to that of FIG. 1 of UKPS No. 1,534,590.

Referring now to FIG. 1 of the accompanying drawings there are sixteen longitudinal coils (CL) and thirty-two transverse coils (CT) in the sorting station array (referred to the direction of movement of objects through the station). By the circuit arrangement to be described the position of the indicator is identified in terms of the identity of longitudinal and transverse coils and this position supplied as output signals OL and OT (longitudinal and transverse respectively) for application to suitable means, e.g. shift registers, to record the identity information and supply it to conveyor exit selection means to sort objects indicated by the indicator.

The identity of the indicated position, and if required an assessment of the size of the object at the indicated position, are produced as follows.

When an object position is to be indicated the "wand" is taken up by an operator at the sorting station. The wand W, not shown in detail, is energised to radiate pulsed radiation at a frequency of some 200 to 300 KHz, and typically 240 KHz, pulsed at a frequency of a few hundred Hertz, say 200, Hz to be picked up by the coils. A push-pull output stage is preferred for the wand energisation, which is conveniently of a sinusoidal waveform. The pulses supplied to energise the wand are arranged to reset the control apparatus until a position indication cycle is started. This cycle is started in any convenient manner, for example by a switch or push button WPB on the wand which is operated by touching it on an object to be sorted. A proximity sensor or other technique maybe appropriate in other applications. If required two wands may be used at a sorting station each being energised alternately, with a gap between each energisation to avoid errors, for about one millisecond. Other techniques may be applied for using several wands e.g. a queuing system is readily envisaged.

The circuit arrangement of FIG. 1 has two main sections, one for the longitudinal coils and one for the transverse coils. Some parts are common to the two main sections. The transverse coils are considered first.

There are thirty-two transverse coils, not all of which are shown in the drawing as all are similar and connected in a similar manner. Each coil is tuned by a parallel capacitor to near resonance with the wand frequency. One end of each coil is connected in common to the mid point (OV) of the bipolar supply voltage for the circuit. Each coil extends across the full width of the sorting station, or inspection area, and in one embodiment the coils are side-by-side at a pitch of about 35 mm. This corresponds, in the specific embodiment, to half of the roller pitch of a roller conveyor used to convey objects for sorting. Considering the coils as numbered 1 to 32 in order, the odd-numbered (primary) coils are connected to a 16 input multiplexer PM and the even-numbered (secondary) coils to a 16 input multiplexer SM. The outputs of the two multiplexers are connected together and passed in common to the input of an analog switch AST. The address system for the multiplexers is provided by a binary counter BCT. The binary counter is driven by monostable MS1. This monostable receives an input from a zero crossing detector ZCD. The zero crossings detected are those of the wand frequency (i.e. some 240 KHz). Conveniently these zero crossings are derived from a signal produced by summing the signals induced in the longitudinal coils CL in a summing amplifier SA and supplying the output of the amplifier to detector ZCD. Thus each zero crossing of the wand frequency causes the transverse coil signal multiplexers to step one pair of coils (a whole roller pitch in this case) and apply the next coil signal to the input of analog switch AST. Sixteen steps cover the multiplexer and the action is then repeated if necessary. About sixteen repetitions are possible in the 1 ms of a wand pulse. As the multiplexers are make-before-break the analog switch is controlled by a second monostable MS2 to clamp the output to OV during the step from coil to coil. Monostable MS2 is operated by the address monostable MS1 to synchronize the operations. The output of the analog switch AST is applied to the input of a high-gain amplifier HGT. In this embodiment the gain is 1500. The output of amplifier HGT is thus a pulse in the form of a half sine wave for each successive coil of the thirty-two transverse coils. The amplitude of this pulse will depend on the closeness of the wand to coil. As the multiplexing action is very fast, each taking only one or two microseconds at 240 KHz for a total of one millisecond, movement of the wand cannot be enough to affect the pulse amplitude. The output of the amplifier is supplied to one input of a comparator CT. The other input of the comparator CT is supplied with a ramp voltage which falls linearly with time from a value higher than the highest value of the output of amplifier HGT. The ramp voltage is produced in a linear ramp generator LRT which is started by a ramp controller RCT in response to the starting of a position indication cycle. The want drive pulse at the starting of the cycle is applied to the control apparatus as an input at WD. This sets the output latches and provides other starting condition signals throughout the apparatus. The ramps will already have been reset to the highest level by the end of a previous cycle. This high level setting avoids spurious signals and false records.

The action of transverse comparator CT is to compare the falling value of the ramp voltage with the varying level of the multiplexed coil outputs. When the falling value equals the instantaneously occurring coil signal the comparator operates and provides an output. It will be understood that there will be repeated cycles of the multiplexed coil outputs until the comparator is satisfied as the coil output level will rise and then fall as the coil nearest the wand is reached but the level may not be high enough during the early part of the ramp. The output of the comparator is applied to a demultiplexer DMT which is operated by the same address system as multiplexers PM and SM. The output of comparator CT will thus appear as an output signal at the appropriate output terminal of demultiplexer DMT for the coils nearest to the wand. Each output terminal of the demultiplexer has a respective latch OTA to OTN, and this latch is thus set by the operation of the comparator CT to indicate the transverse coil nearest to the wand.

The output from the comparator also acts on the ramp control to stop and reset the ramp and permit only one latch to be set. The stopping of the ramp and the inhibiting of the demultiplexer DMT are used as an indication that the transverse coil data has been "entered", for subsequent use to control the selective discharge apparatus. Further wand pulses are also inhibited from acting on the transverse comparator CT at this stage.

Only fourteen of the sixteen possible latches are provided as the outermost ones are omitted to leave a barrier at each end of the inspection area beyond which no data can be entered as the demultiplexer will be inhibited but no latch set.

A further precaution against false data entry is to strobe the comparator not to be responsive during the leading and trailing edges of a wand pulse as these may be distorted or affect the amplifier output quality.

The strobe signal is produced by two monostables in cascade, MS3, MS4 operated by the "wand drive" cycle starting pulse WD. The first monostable provides a delay to allow the leading edge to pass and the second then times the major part of the pulse before inhibiting the circuit during the trailing edge.

Turning now to the sixteen longitudinal coils CL and the associated circuits, these sixteen coils each extend the length of the inspection area at a pitch of about 30 mm. Again each coils is tuned to near resonance at the wand frequency and connected to the supply voltage midpoint (OV). In addition to the summing amplifier SA already mentioned, a multiplexer ML is provided with an input for each coil. The address system for muliplexer ML is a binary counter BCL driven by the same signals as counter BCT.

The multiplexed output of ML is, as for PM and SM, applied to an analog switch, in this case ASL, and then to a high gain amplifier HGL again with a gain of 1500. The output of switch ASL is controlled in the same manner as switch AST. The output of amplifier HGL is applied to one input of a comparator CL1. To the other input a ramp voltage from generator LRL, similar to that from generator LRT, is applied. In this case the ramp generator LRL is controlled by a respective control circuit RCL from the same control signal as is circuit RCT, which signal also controls the binary counters BCT and BCL.

The output of the comparator CL1, as for comparator CT, indicates that the falling value of the ramp voltage has just been equalled by the instantaneous value of the coil signal. This, as before, identifies the coil nearest to the wand but this time in the transverse sense as each coil is lengthwise. Via demultiplexer DML and the latches OL1 to OL16 the coil identity is recorded, as before the transverse coils. Here however there are sixteen latches and no barrier zone.

A further difference is an additional circuit for assessing the proximity of the wand to the coil whose identify is placed in the latches OL1 to OL16 so the first comparator CL1 does not inhibit further action when it is satisfied as just described.

In addition to the linear ramp generator LRL there is an exponential ramp generator ERL started at the same time as the linear ramp. The exponential ramp signal (voltage falling with time) is applied to one input of a further comparator CL2. The other input is supplied by a voltage ladder unit VLU.

When one of latches OL1 to OL16 is set, as above, a respective transistor in unit VLU is operated to produce a downward voltage step at the output of unit VLU. This downward voltage step is thus one input for comparator CL2, once one latch has been set. The comparator CL2 is satisfied when the step input is below the exponential ramp input.

This arrangement provides an assessment of the proximity of the wand for the following reason. If the wand is close to the array of coils when indicating the object the output signal from a coil will be high and the linear ramp will be intersected before much time has passed. The set latch produces one downward step of the ladder voltage and this will then have gone below the exponential ramp voltage which will not have had time to fall very much. Comparator CL2 is satisfied and the output inhibits the demultiplexer DML and stops and resets the ramps via control RCL. The set latch becomes the entered data and no further action occurs until the next position cycle.

However if the wand is further from the coils because the object prevents the wand being close to the coils the output signal will be much smaller and the linear ramp and the exponential ramp will have lower values before the linear ramp comparator is satisfied to set a latch identifying a coil. The single downward step of the ladder unit output will not have a value below that now reached by the exponential ramp. The comparator CL1 remais open to receive another input pulse, which can be smaller, and set another latch. This, by producing another step, may satisfy comparator CL2. If not further input pulses are awaited until the comparator CL2 is satisfied. The ladder unit is reset at this time.

In practical terms if the object whose position is to be indicated is large it will not be possible to bring the wand as close to coils when touching the object with the wand as when the object is small. By setting several adjacent latches in the sense across the conveyor an appropriate provision for the object to be sorted is made in the selectors operated by the latches.

Thus an aperture or a support centred approximately on the position of the object across the conveyor and matching the size of the object can be created. There is not any need for a conveying surface divided into specific pockets, as in the prior art, and any mixture of variously sized objects can be dealt with and sorted effectively.

It is preferred to use a conveyor of roller form as this simplifies the translation of the lengthwise sense of object position information to the selectors by providing a "modular" form to the conveyor. However a plain conveyor surface could be used with attention to any slip of the conveyor on the conveyor drive. If required the conveyor could be permanently or transiently calibrated, e.g. by optically, magnetically or electrostatically readable marks in known manner, to provide precise information on drive action and overcome slip problems. In the illustrated embodiment the information is provided by an optical system using a slotted disc.

Precautions may also be required to prevent malfunction when a high level of electrical interference exists, for example from electrical machinery or radio equipment operating nearby.

FIG. 3 shows a circuit which may be added to that shown in FIGS. 1*a* and 1*b* to provided protection against such electrical interference. The circuit is arranged to control the transfer of the output conditions of the latches OTA and OTN on to the shift register stage previously referred to above. If interference which could affect these transferred conditions occurs transfer is inhibited. In detail, as shown in FIG. 3, an array of sixteen AND gates (IGA to N) is provided, one gate for each latch output (totalling 14) together with one gate DEG or the DATA ENTERED signal path and one gate to fan-out the output of one monostable integrated circuit to permit it to drive all these gates. These gates are controlled by signal from an interference pick-up circuit PUC using a pick-up coil. The pick-up circuit PUC is similar in form and location to the coil used to locate the position of an object so that interference likely to affect the sensing of the position of an object is detected. The coil is tuned as described above. Apart from conventional power supplies not shown in detail, two other inputs are required and these are obtained from the main circuit in FIGS. 1*a* and 1*b*. The inputs are the wand drive, WD, and the signal STROBE which suppresses response, during the leading and trailing edges of wand pulse, produced by monstables MS3 and MS4 (FIG. 1*a*).

The output from coil PUC is applied to difference amplifier DA1 in cascade with a second difference amplifier DA2. One input of the second amplifier DA2 is connected to an adjustable potential divider PD to set an input voltage level which, in the absence of another input, maintains the output level of the amplifier below the operating voltage of the TTL type NAND gate BG1 connected to the output. Gate BG1, with another similar NAND gate BG2 form a bistable BS. The other input to the bistable BS is the wand drive WD. The output of the bistable is connected to a monostable MS5 as an inhibit control signal. The input to the monostable MS5 is the STROBE signal connected through an inverter INV. The output of the monostable MS5 provides a second strobe signal, STROBE 2, analogous to STROBE, which is arranged to enable the gates IGA to ING and the data enter gate DEG so that the DATA ENTER signal and the position information for the shift register stage presets can pass through.

The operation of this circuit is as follows. In the absence of any output from circuit PUC the bistable BS is reset by the wand drive pulse WD and monostable MS5 is not inhibited. The STROBE signal operates the monostable MS5 to generate the STROBE 2 signal which enable the gates IGA to JGN allowing the passage of position information as usual.

If interference is picked up by circuit PUC this is amplified by amplifiers DA1 and DA2 to overcome the bias from divider PD and produce an output from amplifier DA2, generally a spike, which sets bistable BS to inhibit monostable MS5. If the interference occurs after a wand drive pulse so that false position information could be produced the inhibited monostable MS5 is unable to generate STROBE 2 when STROBE occurs and positional information can not be supplied through gates IGA and IGN. In this way no data can be entered in the presence of interference. To tell an operator that data has not been entered a light on the wand is lit only when data is entered so that marking action is repeated until the light is lit.

Details of the fixed bias arrangements and any waveshaping for the interference pulse will be apparent to those skilled in the art and are not described. Also the choice of suitable integrated circuits is readily made from the commercially available.

While no specific circuit elements have been set out it will be readily apparent to those skilled in the art how to construct the arrangement from commercially available integrated circuits and discrete components appropriate to the conditions of use of the arrangement. Clearly any appropriate supply voltages and signal levels, as well as frequencies, may be used. The specific values given are only by way of example and relate to an embodiment for a potato sorting conveyor using rollers of 70 mm pitch and some 500 mm long (i.e. conveyor width). Other sizes are clearly usable.

Precautions are taken to prevent false data entries. Data can only be transferred to the latches in the interval from the actuating of the wand, e.g. with push button WPB, to the operation of the proximity comparator CL2 when the ramps are all reset to "high". The whole arrangement is based on a free-running clock whose pulses are gated by a proprietary dual pulse synchronising gate circuit (e.g. that of Texas Instruments). When the wand is actuated the gate circuit lets the next clock pulse pass to start the cycle and continues to let clock pulses through until data for both transverse and longitudinal information is in the latches for use by the associated shift registers.

In certain conditions of interference, or when two wands are in use, it may be useful to synchronise the operation of wands with a particular point of the a.c. mains waveform, e.g. a zero-crossing, and/or with each other in a particular relationship. FIG. 4 shows an arrangement by which two wands can be operated with reference to respective zero-crossing polarities.

In outline the positive and negative going zero-crossings of the mains waveform are detected and used to operate a monostable of pre-set period. The output of this monostable is applied to a chain of fixed period monostables which generates the respective wand drive pulses offset in time from one another.

Referring to FIG. 4 a transformer T1 energised from the supply mains and having an earthed interwinding screen and core provides two secondary outputs, one for a 5 V regulated power supply PSU and the other is provided a waveform signal for a differential amplifier DA3. The output of the differential amplifier DA3 is connected to two monostable MS11, MS12. Monostable MS11 responds to a positive zero-crossing edge and MS12 to a negative going zero-crossing edge to generate short pulses at these times. These pulses are supplied as inputs to a monostable MS13 of adjustable pre-set period. The output of monostable MS13 is connected to the input of a chain of cascaded monostables MS14, MS15, MS16, each of fixed period. Monostable MS14 produces a wand drive pulse WD1 immediately after the end of the period of MS13. Monostable MS15 introduces an offset in time before monostable MS16 produces a separate wand drive pulse WD2. In this way wand drive pulses for different wands can be kept apart and also, of required synchronized with a specific part of the mains waveform so that mains generated interference can be avoided. Suitable components will be apparent to those skille din the art and integrated circuits of the 74123 type have been used for MS11, 12, 14 and 15 and of the 74121 type for MS13 and 16.

The coils are preferably constructed by printed circuit technique on one or more suitable substrates. The use of "half-pitch" coils in the transverse direction avoids interaction between the coils and false data.

No details are given of the use of the signals from the latches as a suitable arrangement will readily be understood from the above mentioned UKPS NO. 1,534,590.

However by way of example FIG. 2 shows a sorting station and control means for a potato sorting arrangement.

A roller conveyor RC is arranged to receive and convey potatoes in the direction of arrow A. The potatoes are to be sorted, e.g. for soundness, and acceptable ones passed to a conveyor LC in the direction of arrow C while unacceptable ones are dumped on to conveyor TC in the direction of arrows B.

In their passage through the region ST, indicating a sorting station, an operator examines the potatoes and indicates unacceptable ones by placing a wand W on or close to the potato to be rejected.

A coil array CA beneath the conveyor RC is connected to a control means, to which wand W is also connected. Coil array CA is conveniently a large printed circuit board BC on which pick-up coils are deposited as printed circuit tracks. For example the transverse coils CT and the longitudinal coils CL of FIG. 1 could be placed on the two faces of the board CB as indicated schematically in the drawing. A suitable connector CC is provided to connect the coils to the control means. The tuning capacitors are not shown, neither are details given of the wiring layout which may be used to avoid interference at the frequencies used. However these details should be readily supplied by those skilled in the art.

The passage of a potato in directions B or C is determined by a selectively operable ramp RS which can bridge the gap between the conveyor RC and the conveyor TC. Ramp RS is formed by a number of pivotally mounted rods which can be urged by respective actuators RSA to bridge the gap or not bridge the gap.

Unsound potatoes pass in a direction B, and the ramp is caused to bridge the gap, thus such potatoes will pass to transverse conveyor TC. However to allow sound potatoes to pass, the rods are kept withdrawn from the dotted-line to the full-line position to open a path for these potatoes in direction C to a conveyor LC which moves in the same direction as roller conveyor RC to reduce risk of the potatoes hitting one another. Clearly the reverse arrangement can be used if required provided reliable results are attained. Other selective discharge techniques may be used if appropriate.

The selective operation of the ramp rods is achieved by the control means in accordance with the description of FIG. 1. The identity of the coils defining the postion indicated by indicator wand W for an unsound potato is determined as described above and recorded in the latches. This information is transferred to a suitable means, e.g. a shift register as described in UKPS No. 1,534,590 referred to above, and the shift register operates the appropriate actuators RSA to extend the rods when the potato arrives at the ramp at the end of the conveyor. Two rods at least are conveniently used to ensure that an unsound potato is fully supported and can not fall onto the "sound" conveyor. Even if a sound potato is partly supported by a rod it will fall onto the correct conveyor. If required some form of movement information MI can be supplied to the control means to indicate the movement of the conveyor RC so that the time of arrival of the potato at the ramp is precisely indicated. However this information may not always be required e.g. if the speed of the conveyor is known and is constant a prediction technique can be used.

As mentioned above the size of an object can be assessed so if a large potato is to be rejected more rods can be used to produce a suitably sized ramp. The ramp actuators RSA can be hydraulic or electromagnetic or other suitable types.

The ramp has been described as formed of rods but other elements can be used. For example overlapping sheets of material could be moved apart to provide an aperture adjustable in position and size, somewhat in the manner of a focal plane camera shutter.

FIG. 5 shows another embodiment of the invention in which item position information is produced in a form suitable for direct entry into a microprocessor which controls the conveyor exit selection means. This embodiment does not require the arrays of latches used in the embodiments described above but produces the position information as binary words. The binary words are associated with a conveyor progress signal so that a binary word associated with a particular part of the conveyor can be altered after it has entered the microprocessor. This embodiment can also have a number of wands, eight in the present example, which are enabled in turn by gates controlled by a counter/divider clocked by a multivibrator.

The action of the arrangement in outline, is as follows. Each wand has piezo-electric element so that when applied to an item a pulse signal is generated. This signal, gated with the counter/divider output can enable the wand oscillator, described above, and the ramp generator for the comparator action.

The comparators, one for each coil representing a row (crosswise) or lane (lengthwise), receive the ramp signal and a signal produced by rectifying the output of the coil. All the row comparators and lane comparators operate at the same time and once one row or one lane comparator has operated the other similar comparators are inhibited. The identity of the operated row and lane comparators is encoded as binary words and these transferred, subject to a validity check, to the microprocessor. At the same time a conveyor progress signal is transferred to the microprocessor. This information enables an operator to transfer the position of an item into the microprocessor when the time is anywhere on the conveyor and to revise the information transferred if required.

Figure 5A:
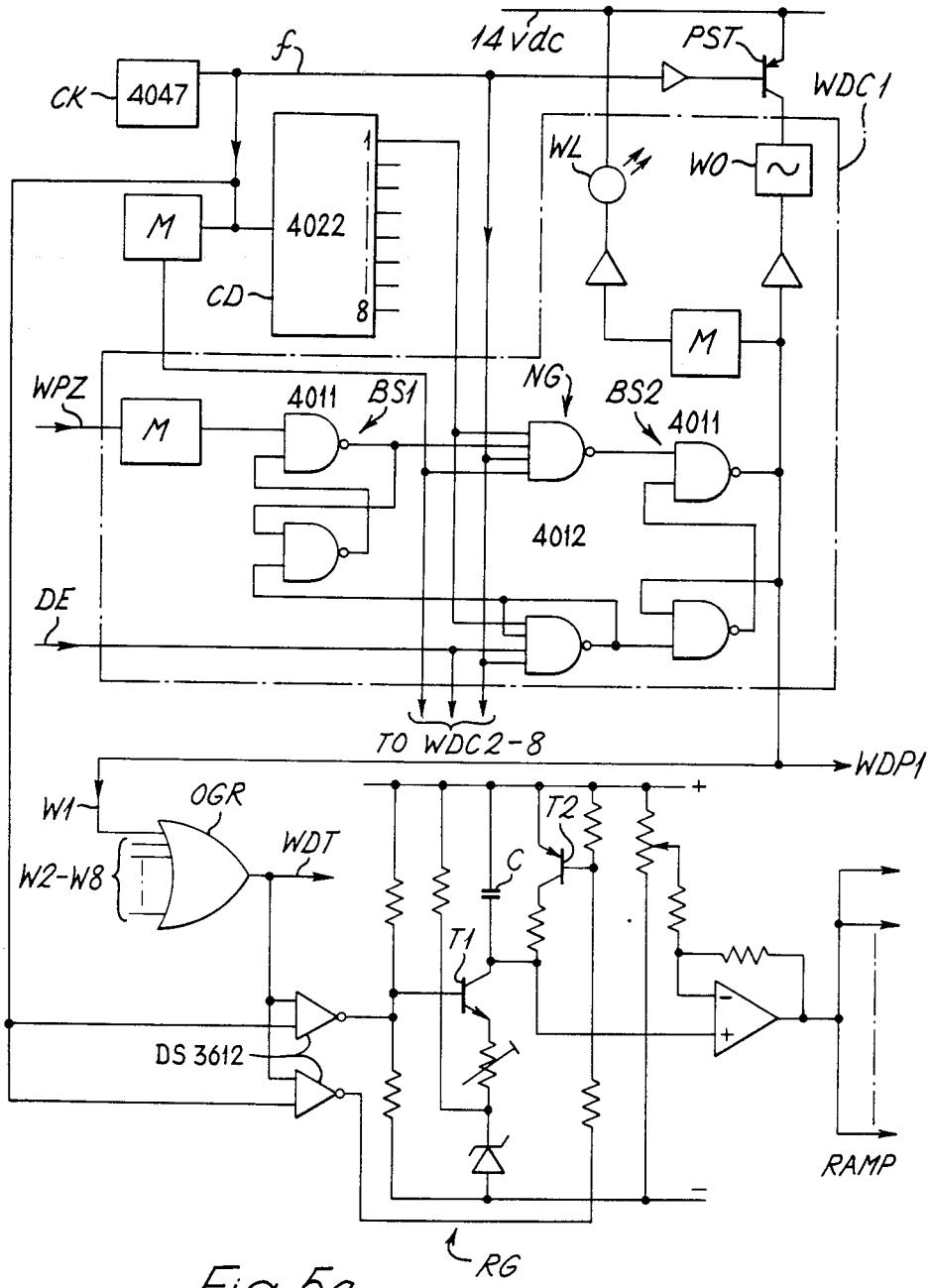
Figure 5B:
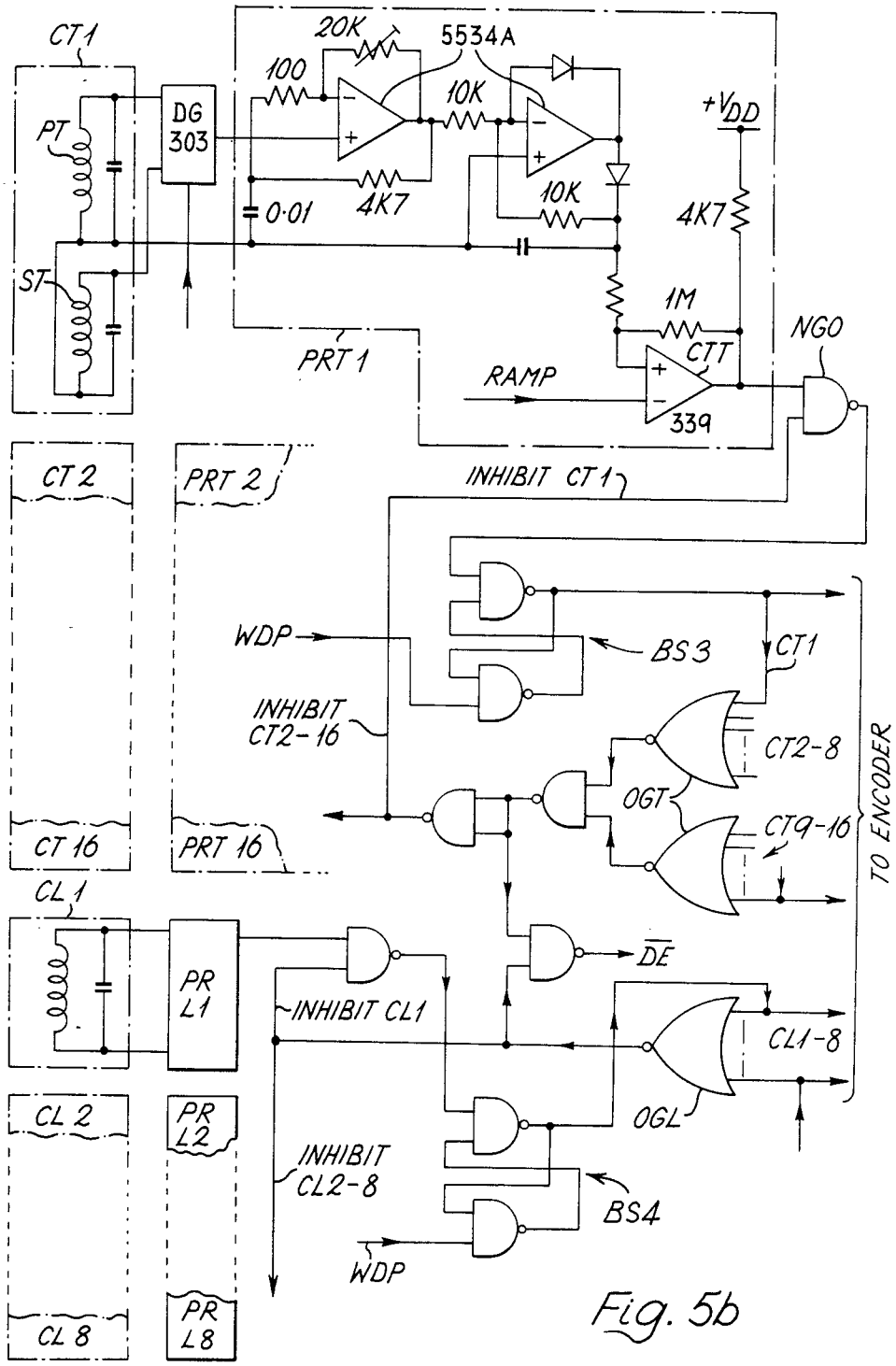
Figure 5C:
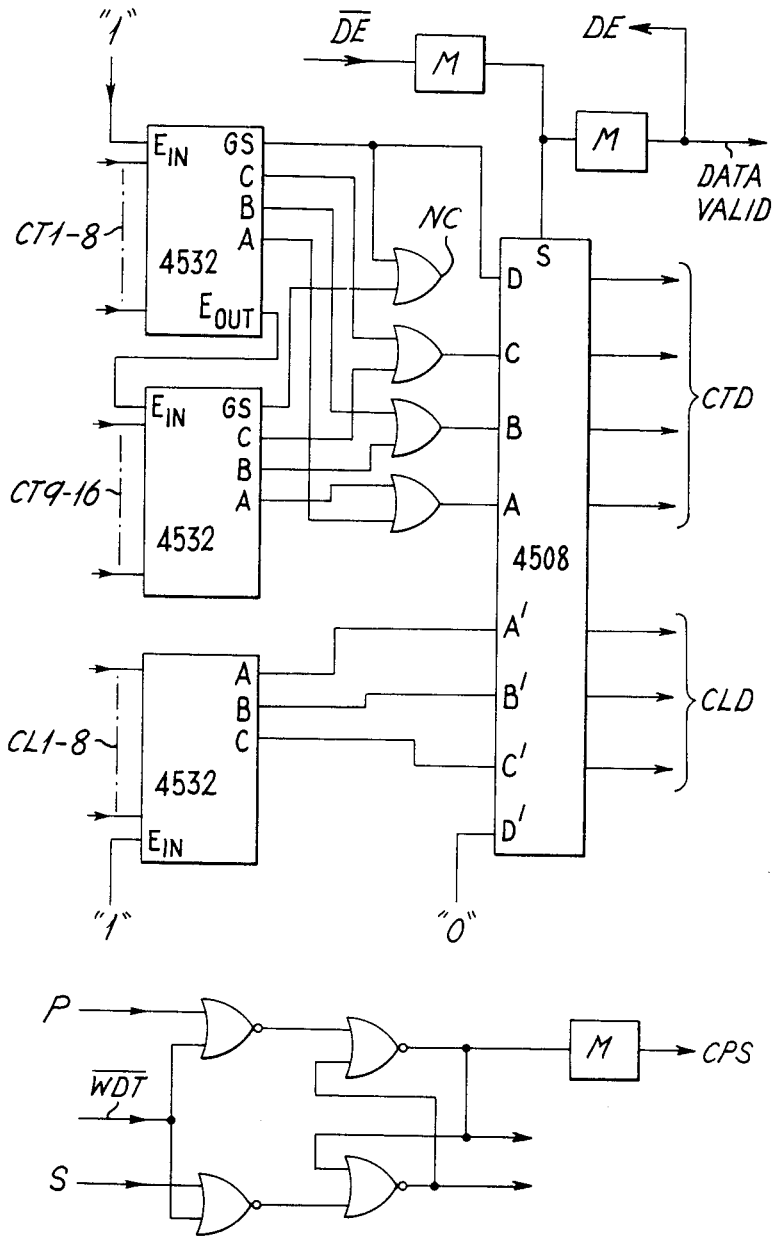

The circuit shown in FIGS. 5*a*, 5*b*, 5*c* is now cosidered in more detail. Routine electronic logic and circuit actions will not be described as those skilled in the art will understand these. In these figures M indicates a monostable, and integrated circuit type numbers are also shown.

Referring first to FIG. 5*a* this shows a free-running clock CK producing a frequency f. The frequency f is supplied to a counter/divider CD and to a monostable. The counter/divider CD produces a sequence of eight outputs. Eight similar wand drive circuits WDC1 to WDC8, of which only WDC1 is shown, are each driven in turn by a respective one of these eight outputs supplied to a gate NG of two four-input NAND gates, type 4012, in each circuit. Another input to these NAND gates is the continuously available frequency f. These NAND gates are arranged to control the energisation of the wand when an operator applies the wand to an object to indicate a position to be recorded. The wand has a piezo-electric crystal to generate a signal WPZ when the wand is pressed onto the objects. This signal operates a monostable the output of which is connected to a bistable BS1 of type 4011 circuits to set the bistable. The bistable is connected to one of the NG circuit NAND gates. When the counter/divider output occurs for the wand which has generated the signal WPZ this NAND gate can be enabled and set a second bistable BS2 of type 4011 circuits. The remaining input for this NAND gate is from a monostable operated by the frequency f. The bistable BS2 is only reset when a valid data entry has occured, indicated by a signal DE, which can enable the other NAND gate during the occurrence of the respective counter/divider output. The bistable BS1 is reset in the same way. The power supply to the wand oscillator is also controlled so that the wand can only radiate when required to. Conveniently a power transistor PST switches on the wand oscillator supply from the +14 v d.c. rail when the required clock half cycles occur. A suitable driver stage can be interposed as shown if required. A wand drive circuit such as WDC1 is thus brought into operation only when all the conditions for proper action are satisfied. Furthermore the start point and duration of the resulting wand energisation are linked to the clock frequency. The midpoint of the counter output is a narrow edge, the beginning of which turns the wand oscillator WO on through the second bistable and keeps it on only for a full half cycle of the clock. When the oscillator is turned off a light WL on the wand is lit. The control signal for the wand oscillator is available at WDP1 for later stages.

A ramp signal is required whenever a wand is energised so all the wand control signals from circuits WDC1 to WDC8 are gated in or OR gate OGR, to provide a control output for a ramp generator RG. The OR gate OGR for eight circuits is conveniently a triple three-input OR gate integrated circuit. As the ramp generator operates with a higher supply voltage than the logic circuits, both to provide adequate power and ensure adequate voltage swing for linearity, a high voltage dual NAND gate drive DS3612 is driven by signal WDT, the output of the wand drive pulse OR gate. The D3612 gates are also responsive to the clock frequency f to synchronise the operation of the ramp generator. The ramp is produced by charging a capacitor C at constant current from a positively discharged condition produced by transistor T2 being made conductive by one NAND gate of circuit DS3612. The changing collector potential of transistor T1 produces the ramp. The zener diode in the emitter circuit of transistor T1 keeps the bases of the transistors above the saturation voltage of the DS3612 circuit. The differential amplifier acts as a level shifter to position the ramp potential swing for subsequent circuits.

Thus far the circuit produces a precisely timed drive signal for an operated wand and a ramp synchronized with the signal.

FIG. 5*b* show the circuit elements by which the wand position is identified. A coil matrix similar to that described above is used. In this embodiment eight longitudinal coils CL1 to CL8 (lanes) and sixteen transverse coil pairs (rows) CT1 to CT16 are used. In distinction from the embodiments in FIGS. 1*a* and 1*b* the ramp signal is applied to a comparator, such as PRT1, PRL1, for each coil at the same time. The comparator that responds is then identified.

The comparators are actually based on precision rectifiers to ease setting up of the equipment and provide stable operation. Comparaor PRT1 is typical and includes two differential amplifiers to process the coil signal, the first arranged to amplify the a.c. output of a coil and the second to rectify the a.c. output to provide a pulse whose amplitude is related to the proximity of the wand to the coil. This pulse amplitude is compared with the falling ramp level in a third differential amplifier CTT to which the ramp from generator RG is applied. The action is generally as described above. For the transverse position coil pairs (primary and secondary) are provided as described above and are selected by circuit DG303.

It will be seen from FIG. 5*b* that the sixteen transverse coils pairs and the eight lengthwise coils each have a precision rectifier PRT1 to 16 and PTL1 to 8 respectively) each including a comparator such as CTT to which the ramp is applied. On the wand being energised as described above the ramp is also generated so all twenty-four, in this embodiment, coils and comparators operate at the same time to process the coil signals and compare them individually with the ramp. The outputs of the comparators are gated together so that the first comparator, in each direction, to operate thereby inhibits the others and has its identity forwarded for encoding.

The inhibit arrangement is as follows. Each coil signal channel has a NAND gate such as NGO at the output of the channel. The output of a gate NGO is applied to a respective bistable BS3 and, via the bistable, to an OR gate. One OR gate, OGT, handles the transverse signals and the other, OGL, the lengthwise signals from bistables such as BS4. The bistables BS3 and BS4 are enabled during the wand drive by the signal WDP and the gates NGO are also emabled by the absence of the INHIBIT signal. The output of the first comparator to respond is thus applied to an OR gate OGT or OGL as appropriate and brings the INHIBIT signal into action to block all the similar other comparators. The identity of the comparator that has responded is shown by the bistable that remains set by the passage of the comparator output. These outputs, which indicate one of coils CT1 to CT16 and one of coils CL1 to CL8, are supplied to an encoder, shown in FIG. 5*c*.

The encoder includes an integrated circuit eight input priority encoder, type 4532, for each group of eight coils. Two encoder circuits are gated, to deal with the sixteen tranverse coils, using OR gates. (One is connected only to provide proper loading.) The identity of an operated comparator, provided by a energised output of a bistable such as BS3 or BS4, is thereby converted to a binary word, of four or three bits as appropriate, produced by the encoders. These binary words are applied to a latch, circuit type 4508, from which they can be supplied to a microprocessor. The use of a latch permits the transfer of the data to be "strobed" and the data to stabilise. The inhibit gate arrangement in FIG. 5*b* includes a gate to produce a signal "not data entry", $\overline{DE}$, when the comparators operate. This signal is applied to the stobe input of the latch type 4508 via a monostable. A second monostable responsive to the trailing edge of the operation of the one driven by signal $\overline{DE}$ permits the data to stabilise in the latch and then produces the "valid data to microprocessor" signal DATA VALID and the signal DE to complete the cycle of operation by re-setting the wand drive circuits by action on gate NG (FIG. 5*a*).

Protection against interference can be provided using techniques similar to those described with reference to FIG. 3 The arrangement of FIG. 5*c* is modified so that the monostables associated with the strobe input of the latch type 4508 can be inhibited during interference. The $\overline{DE}$ signal is applied to one input of a NOR gate, the output of which controls the inhibition of the monostables. The other input of the NOR gate is controlled by a bistable of NOR gates. The bistable is operated at one input by a pulse of the clock frequency through NOR gate arranged as an inverter, and at the other by a positive going pulse from the interference detector. (The output of the FIG. 3 detector is reversed to produce the polarity.) The $\overline{DE}$ input to the first monostable is replaced with a signal derived from the wand drive pulse front edge via a monostable. This arrangement produces a closely controlled time interval during which valid data can be created.

It is observed that a tuning capacitor is not essential for the interference pick-up coils but can be used if required.

FIG. 5*c* also shows the circuit which provides a conveyor progress signal CPS for the microprocessor. This is produced by a monostable operated by a bistable BS5, which responds to signals P and S generated at a point on the conveyor when it passes from the secondary of a transverse coil to the primary of another. The signal $\overline{WDT}$, from OR gate OGR (FIG. 5*a*) via an inverter, not shown, locks out this circuit during wand pulses. The outputs from the bistable also control the selection of primary and secondary transverse coils for the comparator, via circuit DG303.

The arrangement described permits a number of wands to be used at the same time while ensuring the rapid and reliable transfer of position information to the microprocessor in step with validity and conveyor position information by using the "hand shake" technique.

Other variations of the above arrangements are possible to produce particular benefits. For example a random access memory may be used for the position information instead of a shift register. This saves space and integrated circuits. Furthermore this permits the reversal of a rejection by remarking an operation to revise the stored information. In addition to the simple pass/fail decision described above quality grading may be provided by arranging the position information to be associated with a quality signal. This can be a multilevel signal, say three levels and could be added to the block of information transferred as shown in FIG. 5*c*. The quality signal could be generated by using specific wands or having controls on the wand settable by the operator. In the embodiments described above the ends of the wand pulse are "masked" to prevent false interaction with the ramp. If the permitted range of coil signal is well inside the range of the ramp then this "masking" is not needed as the wand pulse will be in the undistorted region by the time the ramp has run down to the possible pulse levels, with a similar result at the lower levels.

The important advantage of the present technique over that described in UKPS No. 1,534,590 is that the conveyor does not have to be designed to provide pockets for individual objects. Conveniently the roller pitch matches the transverse coil pitch but apart from this, which is not essential, as many objects as will fit on can be placed across the conveyor and their position can be indicated by the wand and recorded to permit them to be sorted. Also sensing directions other than along and across a conveyor may be used.

Objects can be sorted into "good" and "bad" groups, into two "good" groups, e.g. "large" and "small" or more than two groups. The objects may be agricultural products, e.g. fruit or vegetables, or other items.

I claim:

1. Sorting apparatus including a support surface to receive objects to be sorted, means to move received objects to a point of selective discharge from the support surface, means to produce said selective discharge, an indicator movable to objects supported on the surface to indicate the position of an object to be sorted in a particular way by said selective discharge, means to co-operate with the indicator to record the position of the indicator and the proximity of the indicator to said recorded position, means to generate a signal to identify the position to be recorded, means responsive to the recorded position and to the action of the means to move the objects to operate said selective discharge means to appropriately sort the object on discharge from the surface, and including means responsive to the record of the proximity of the indicator to said position to generate a signal representing the size of the object whose position is indicated, said means to produce selective discharge being responsive to said object size signal to adjust the suit the size of an object to be discharged.

2. Apparatus according to claim 1 in which the indicator includes means to generate a signal and the means to co-operate with the indicator includes electronic circuit means to compare the generated signal collected by each of a plurality of pick-up means spaced under the support surface with a time-varying signal to determine by their coincidence the pick-up means nearest to the indicator postion.

3. Apparatus according to claim 2 in which the time-varying signal is a ramp changing in value towards the picked-up signal itself changing in the opposite sense as the indicator position is approached.

4. Apparatus according to claim 3 in which the change is linear and in synchronism with a scan of all the pick-up means.

5. Apparatus according to claim 2 in which the comparison is made separately along crossing directions below the support surface.

6. Apparatus according to claim 5 in which the directions are orthogonal along and across the direction of movement of the objects.

7. Apparatus according to claim 5 in which there are two directions both inclined to said direction of movement.

8. Apparatus according to claim 2 in which the electronic circuit means to compare the time-varying and picked-up signals is effective to compare the time-varying signal with each picked up signal in turn.

9. Apparatus according to claim 2 in which the electronic circuit means to compare the time-varying and picked-up signals is effective to compare the time-varying signal with all the picked-up signals at one time.

10. Apparatus according to claim 2 including means to protect the action of the apparatus from electrical interference including a further pick-up means under the support to respond to electrical interference incident on the apparatus to produce a signal to inhibit the transfer of the result of the comparison of the collected generated signal.

11. Apparatus according to claim 2 in which the identity of the pick-up means determined on the coincidence of the signals is retained in an electronic circuit latch to record the identified position.

12. Apparatus according to claim 2 in which the identity of the pick-up means determined by the comparator means is encoded as a multibit binary word for use by the selective discharge control means.

13. Apparatus according to claim 2 in which the means to co-operate with the indicator includes furthr electronic circuit means to assess the size of the generated signal used to determine the pick-up means nearest to the indicator position.

14. Apparatus according to claim 13 in which the size of the generated signal is assessed by comparison of a further time-varying signal with a signal derived from the time-lapse before the coincidence of the first ramp signal and the generated signal.

15. Apparatus according to claim 14 in which the further signal is an exponential ramp signal.

16. Apparatus according to claim 14 in which the time-lapse derived signal is a stepwise varying voltage.

17. Apparatus according to claim 14 in which the further signal is non-linear.

18. Apparatus according to claim 1 including means to protect the action of the apparatus from electrical interference including means to respond to electrical interference incident on the apparatus when the means to record the position co-operates with the indicator to produce a signal to inhibit the recording of the position of the indicator.

19. A sorting control appartus for a sorting station of a conveyor having at the station an array of signal pick-up coils and an indicator movable over the array to indicate a position of a conveyed object to be sorted from other conveyed objects, together with means to selectively remove an indicated object, the control apparatus including a circuit arrangement to supply a signal from each pick-up coil for each direction of the array to a comparator for comparison with a ramp waveform to identify the coil nearest to the indicator position for each said direction and record the identity of the identified coils and derive information about the proximity of the indicator position to the array corresponding to the size of the object indicated, means to respond to the movement of objects by the conveyor towards the means to remove objects selectively and respond to the indicator position represented by the identified coils of the array to provide an output to the means to remove objects selectively to cause said means to remove a conveyed object, having a position and size indicated by said indicator and then recorded, on movement of said object to the removal means.

* * * * *